US005482219A

United States Patent [19]

Tcholakov

[11] Patent Number: 5,482,219

[45] Date of Patent: Jan. 9, 1996

[54] ROPE GUIDE FOR WIRE AIR OR ELECTRIC HOISTS

[76] Inventor: Stoil M Tcholakov, C/O Kenneth A. Roddy; 2916 W. T.C. Jester Blvd., Houston, Tex. 77018

[21] Appl. No.: 144,332

[22] Filed: Nov. 1, 1993

[51] Int. Cl.[6] ..... B65H 54/28

[52] U.S. Cl. ..... 242/158 R

[58] Field of Search ..... 242/158 R, 158.2, 242/333

[56] References Cited

U.S. PATENT DOCUMENTS

| | | | |
|---|---|---|---|
| 1,782,358 | 11/1930 | Lang | 242/158 R |
| 1,973,446 | 9/1934 | Rosenquist | 242/158 R |
| 2,926,867 | 3/1957 | Nardone | 242/158 R |
| 3,226,090 | 12/1965 | Sauerbrey | 242/158.2 |
| 4,634,078 | 1/1987 | Kaufmann et al. | 242/158 R |

FOREIGN PATENT DOCUMENTS

| | | | |
|---|---|---|---|
| 1756614 | 4/1970 | Germany | 242/158 R |
| 2732108 | 1/1978 | Germany | 242/158 R |
| 108153 | 7/1966 | Norway | 242/158 R |
| 2061861 | 5/1981 | United Kingdom | 242/158 R |

*Primary Examiner*—Daniel P. Stodola
*Assistant Examiner*—John P. Darling
*Attorney, Agent, or Firm*—Kenneth A. Roddy

[57] ABSTRACT

A segmented rope guide formed of sectors encircles the drum of a hoist to guide a rope being wound onto or unwound from a helical rope groove on the drum and press the rope into the rope groove. The sectors have U-shaped interior portions facing inward toward the drum. A slot with inward converging side walls extends through one of the sectors to facilitate passage of the rope therethrough. A plurality of rollers are rotatably mounted in circumferentially spaced relation on axles transversely mounted in the U-shaped portions. The rollers include disc-shaped drum engaging elements that roll in the rope groove, and rope engaging elements having disc-shaped portions received in grooves between adjacent turns of rope with inwardly curved surfaces on each outer side of the disc-shaped portion that roll on the outer surfaces of the adjacent turns of rope. The sectors are spring biased radially inward toward the drum by a spring mechanism to urge the drum engaging elements into rolling engagement with the rope groove and the rope engaging elements into rolling engagement with the outer surfaces of adjacent turns of rope and grooves therebetween. Upon relative rotation between the drum and rope guide, the drum engaging elements and the rope engaging elements move the rope guide axially of the drum and maintain the slot aligned with the rope groove, and the rope engaging elements rolling on the outer surfaces of the turns of rope press the turns of rope into rope groove.

9 Claims, 2 Drawing Sheets

ROPE GUIDE FOR WIRE AIR OR ELECTRIC HOISTS

FIELD OF THE INVENTION

The present invention is directed to a mechanism for guiding a rope being wound onto, or unwound from a drum. In particular, but not exclusively, the invention relates to such a rope guide for guiding a rope being wound into, or unwound from, a helical groove formed in the peripheral surface of the drum of a hoist, for example an electric hoist. It also relates to a hoist provided with such a rope guide.

BACKGROUND OF THE INVENTION

A known rope guide for an electric hoist having a drum provided with a helical groove on its peripheral surface comprises a nut whose thread has the same profile and pitch as the groove in the drum of the hoist. The nut consists of three steel shells filled internally with a lining, joined together with the exception of the adjacent ends the first and third sectors which are connected together by a cleat provided with slot through which the rope passes into the rope guide. This slot serves to guide the rope as it wound onto, or unwound from, the drum. At one of its ends the nut has an internal peripheral groove in which the spring pressing member is received. The spring pressing member is tightly pressed against two adjacent rope turns lying in the groove of the hoisting drum. The rope-guiding slot is located between the nut thread and the spring pressing member and is disposed to coincide exactly with the drum groove. When the hoisting drum rotates, the nut does not rotate around its axis, but is moved along the drum axis, pushing the spring pressing member with it. The latter, of course, rotates with the drum and pushed axially under the action of the nut, jumps over the next adjacent turns of the rope.

The above-described known rope guide has the following disadvantages:

It is expensive to manufacture, the machining of the internal thread in the nut sectors being particularly costly. It has considerable deadweight, which decreases the capacity of the hoist. The efficiency of the hoist is reduced by the high sliding friction force, which is the sum of three forces due to friction between the steel drum and the nut thread, friction between spring pressing member and the nut, and friction between the rope and spring pressing member when the latter moves axially along the drum. Furthermore, the rope guide has a short service life, due to the large radial dimension of the rope guide and the fact that the side walls of the slot in the nut, through which the rope passes, are perpendicular to the drum axis. Because of these two factors, when loaded rope deviates from a direction substantially vertical to the drum axis, a large bending moment acts on the radially outer edge of the slot, which bending moment can result in breakage of the nut sectors, or rapid wear of the nut slot and/or of the rope. Finally, the large axial length of the rope guide (amounting to about 5 pitch length of the drum groove) means that the hoisting drum has to be made considerably longer than that required to provide a given hoisting travel of the rope, and the rope wound onto the drum is considerably longer than that required to provide a given height of the load elevation.

Thus, there exists a need for light durable rope guide mechanism with a high efficiency, low cost, and short axial length.

SUMMARY OF THE INVENTION

The present invention relates to a rope guide for guiding a rope being wound onto, or unwound from, a drum of a hoist, comprising a sectored rolling bearing ring made of U-shaped steel shells adapted to surround the drum and turns of rope wound thereon, one of said sectors being provided with a slot for the entry of said rope into the guide and each sector having welded U-shaped steel shells facing inwardly towards the peripheral surface of the drum, a plurality of axles fixed in said inwardly-facing U-shaped steel shells of the sectors, each of which axles receives a respective rope-engaging member which is rotatable on its axle and rolls over the peripheral surface of two and three adjacent turns of the rope, and a drum engaging member which is rotatable on its axle and rolls over the groove of the drum, whereby, in use of the guide, said rope-engaging members and the drum-engaging members by their axles form a roll bearing, urged inwardly into engagement with the rope and with the drum.

In a prefered embodiment of the rope guide in accordance with the invention, the rope-engaging members are barrel-shaped rollers and double-barrel shaped rollers, and drum-engaging members are disc-shaped rollers. In the case of a rope guide for a hoist having a hoisting drum provided with a helical groove for the reception of the hoisting rope, rope-engaging members in the form of barrel and double-barrel-shaped rollers and drum-engaging members in the form of disc-shaped rollers are mounted on axles which are inclined to the drum axis at an angle substantially equal to the helix angle of the drum groove.

Preferably, each of the sectors comprises a shell made of sheet steel, and each of the shells has internally mounted U-shaped steel shells for receiving the rope-engaging members, and U-shaped steel shells for receiving the drum-engaging members. In the sector which is provided with a slot for the entry of a rope into the guide, the slot preferably has side walls which converge in the radially-inward direction. This sloted sector may be made in two parts which can be assembled and dismantled readily to facilitate feeding of the rope into the guide.

Compared with the previously known rope guide described above, the advantages of a rope guide in accordance with the present invention and having the prefered features mentioned above are that:

It is cheaper to manufacture, since the sectors do not have internal screw-threads. A greater hoisting distance can be provided by a drum of the same length, due to the guide having a shorter axial length, which allows manufacturing of shorter drums and using a shorter rope in one and the same load elevation, due to the guide having a shorter axial length. Since the rope-engaging members rely on rolling friction rather than sliding friction, the overall efficiency of a hoist employing the guide is higher. Furthermore, both the rope guide and the rope employed therewith have a longer service life, due to the fact that the converging walls of the rope entry slot allow the rope to deviate from a direction perpendicular to the drum axis without imparting an excessive bending moment on the guide.

BRIEF DESCRIPTION OF THE DRAWINGS

The invention will now be described, by way of example, with reference to the accompaning drawings, in which.

DETAILED DESCRIPTION OF THE PREFERRED EMBODIMENT

Figure 2:
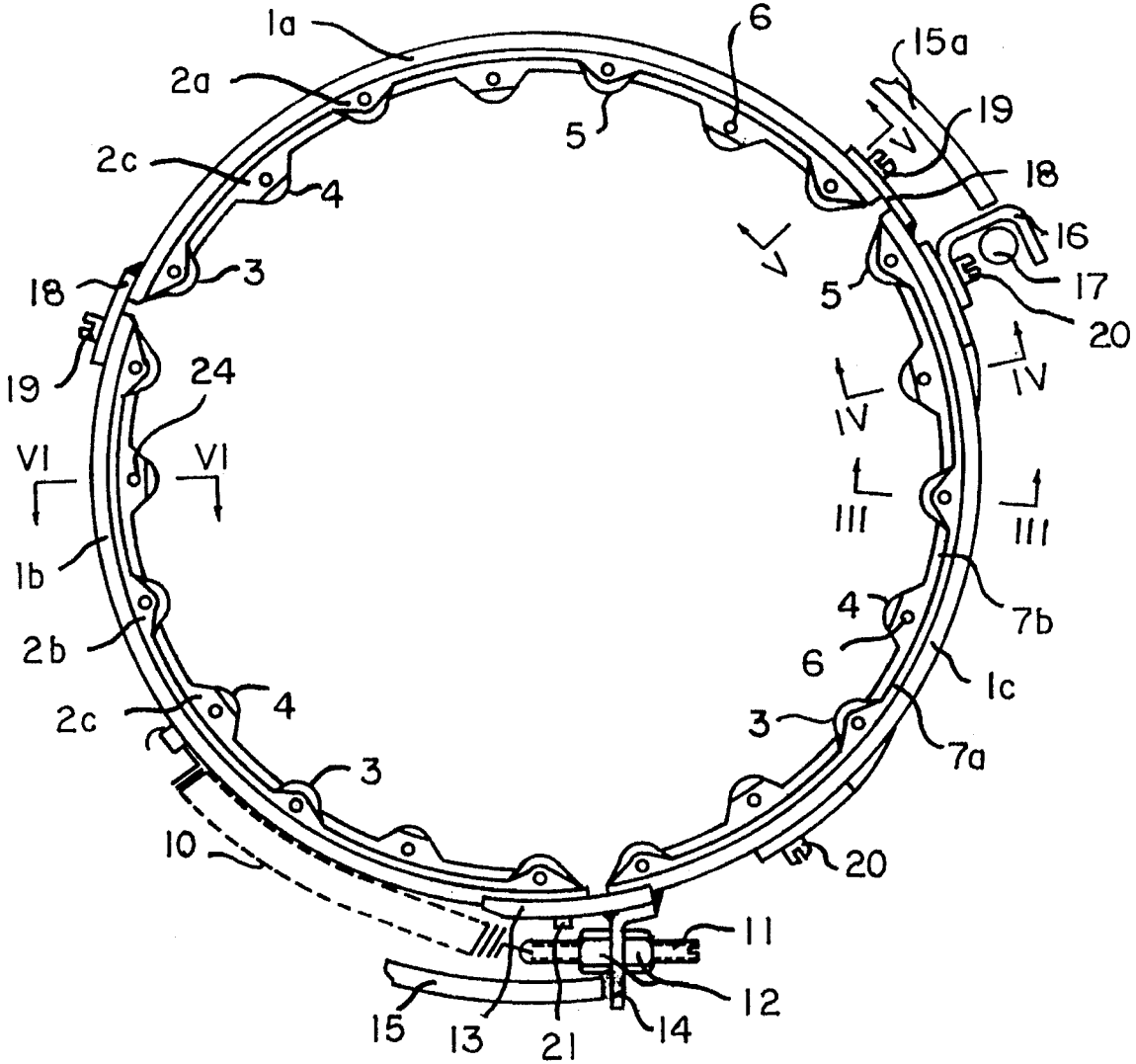
FIG. 2 is an end view of the rope guide, seen in the direction the arrow A in FIG. 1, and FIG. 3 to 6 are sectional views, of an enlarged scale, taken on the lines III—III, IV—IV, V—V, and VI—VI, respectively, in FIG. 2.

The rope guide shown in the drawings is intended for use on the drum of an electric hoist. In the drawing the numeral 8 designates a helical groove in the peripheral surface of the hoisting drum into which the rope 9 of the hoist is wound. Apart from these two items 8 and 9, which are shown in broken lines in FIGS. 3 to 6, the electric hoist is not shown.

The rope guide includes three arcuate sectors comprising sheet steel shells 1*a*, 1*b* and 1*c*, into the interior of each is welded U-shaped shells 2*a*, 2*b*, 2*c*, 7*a*, and 7*b* respectively, made of steel. Each of the U-shaped shells 2*a*, 2*b*, 2*c*, 7*a* and 7*b* is provided with holes for axles 6, 22, 24 and 25 on which rotate disc rollers 4*c*, barrel rollers 3, disc rollers 4*b*, and double-barrel rollers 5, respectively, made of steel. The axes of rotation of all rollers are disposed at an angle substantially equal to the helix angle of the drum groove 8.

Figure 1:
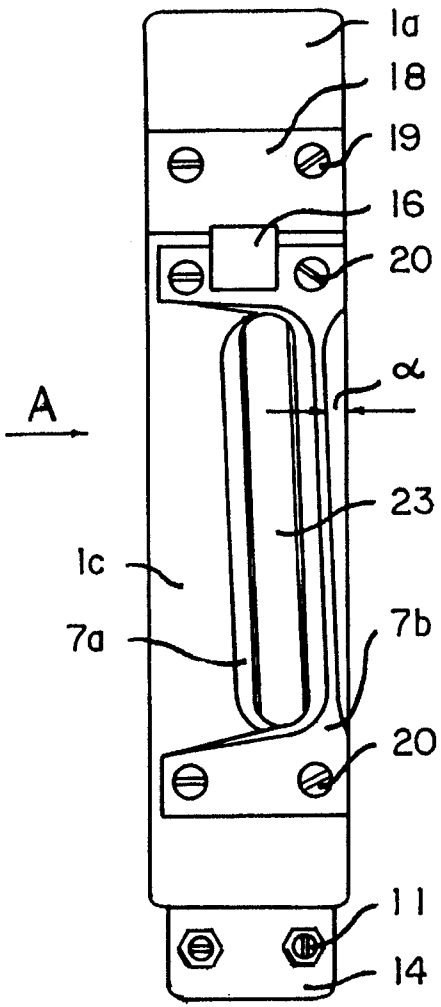
FIG. 1 is a side view of one embodiment of a rope guide in accordance with the invention.
Figure 4:
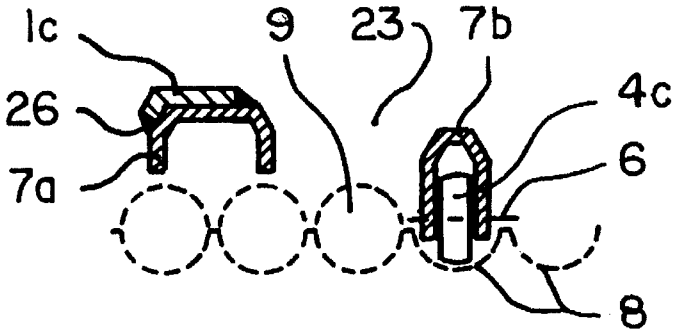

The shells 1*a* and 1*b* are of one piece construction but the shell 1*c* is made in two parts 7*a* and 7*b* connected together by screws 20. When assembled together the two parts 7*a* and 7*b* define a slot 23 in the shell 1*c* through which the rope 9 enters the guide, the side walls of the slot converging in the radially-inward direction ( see FIGS. 3 and 4 ), the inclined angle between these side walls being approximately 60°. The slot 23 is inclined to the side faces of the shell 1*c* at an angle $\alpha$ equal to the helix angle of the groove 8 (FIG. 1).

The pair of shells 1*a* and 1*b*, and the pair of shells 1*a* and 1*c*, are connected together by a steel connection member 18 secured to one of the shells of the pair by screws 19 and welded to the other shell of the pair, as can be seen in FIG. 2. The shells 1*b* and 1*c* are joined by means of a U-shaped cleat 13 having the free ends of its limbs secured, for example welded or screwed, to the shell 1*c*. A catch 21 secured to the end of the shell 1*b* lying adjacent to the shell 1*c* slides between, and is guided by, the limbs of the U-shaped cleat 13 and limits the amount by which the adjacent ends of the shells 1*b* and 1*c* can separate from one another.

Adjacent ends of the shells 1*b* and 1*c* are urged towards one another by pair of helical springs 10 (only one of which can be seen, and is shown in broken lines, in FIG. 2). One end of each spring 10 is anchored to the shell 1*b* and the other end of each spring is connected to a screw-threaded rod 11 mounted in a cleat 14 secured to the shell 1*c*. The position of each rod 11 in the cleat 14 is adjustable by means of a nuts 12. By suitably adjusting the nuts 12 the disc rollers 4*b* and 4*c* are located in the groove 8, and the barrel rollers 3 and double-barrel rollers 5 of all three shells 1*a*, 1*b* and 1*c* are pressed on the rope 9 so that the friction force resisting sliding between the rope 9 and the groove 8 is greater than the total frictional force resisting rotation of the barrel and double-barrel rollers 3 and 5 on their axles. The sliding friction force between the rope 9 and groove 8 arises from the pressing of the barrel and double-barrel rollers 3 and 5 against the rope 9 and the pull in the rope due to the load, the dead weight of the rope and the weight of the hook or other attachment device connected to the rope.

Figure 3:
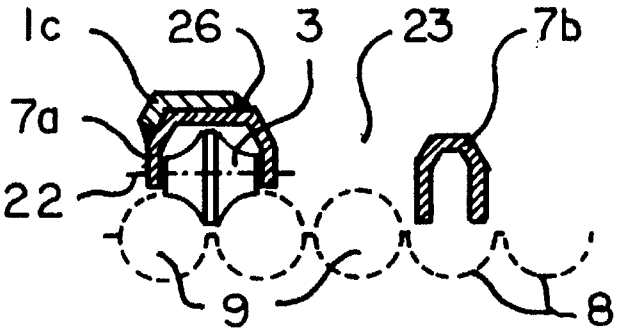
Figure 6:
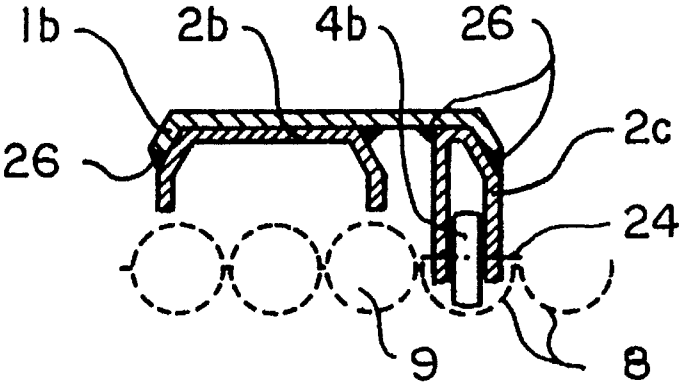
Figure 5:
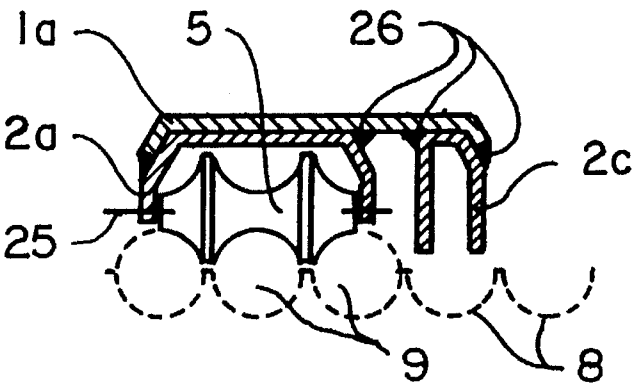

As shown in FIG. 3, the "barrel-rollers" 3 have a disc-shaped portion received between adjacent turns of rope and inwardly curved surfaces on each outer side of the disc-shaped portion which roll on the outer peripheral surfaces of two adjacent turns of rope. As shown in FIG. 5, the "double-barrel rollers" 5 have a first inwardly curved portion which rolls on the outer peripheral surface of a first turn of rope, a disc-shaped portion at each outer end of the first inwardly curved portion received between second and third turns of rope at each side of the first turn of rope, and inwardly curved surfaces on each outer side of each disc-shaped portion which roll on the outer peripheral surfaces of the second and third turns of rope.

Apart from serving as a support to the screw-threaded rods 11, the cleat 14 also serves as a stop member counteracting a clockwise torque (as viewed in FIG. 2) imparted to the rope guide by the rope 9, the cleat 14 being arranged to bear against an abutment 15, which may be a stationary portion of the housing of the electric hoist. Another cleat 16, secured by the screws 20 to the end of the shell 1*c* lying adjacent the shell la, serves as a stop member counteracting a counter-clockwise torque (as viewed in FIG. 2) imparted, to the rope guide, the cleat 16 being arranged to bear against an abutment 15*a*, which again may be a stationary portion of the housing of the electric hoist.

The cleat 16 may also serve to actuate one or more limit switches controlling the electric hoist.

The numeral 17 designates the actuating arm of such a limit switch.

In use of the above-described rope guide, the barrel rollers 3 and double-barrel rollers 5, rotating on their axles in the U-shaped shells 7*a* , 2*a* and 2*b*, roll along the peripheral surface of the rope 9, press the rope 9 into the drum groove 8 as the drum of the hoist rotates. The pressure exerted on the rope by the rollers 3 and 5 can be adjusted by adjusting the tension of the springs 10. As winding or unwinding of the rope proceeds, the rope guide is driven axially along the drum mostly by engagement of the barrel and double-barrel rollers 3 and 5 with the rope, and additionally by engagement of the disc rollers 4*b* and 4*c* in the groove 8, so that the slot 23 is always aligned with the underlying portion of the groove 8. As previously mentioned, the side walls of the slot 23 converge in the radially-inward direction, and due to this the rope 9 can deviate by up to 30° from a direction perpendicular to the drum axis without imparting an excessive bending moment on the shell 1*c*. From FIG. 2 it will be seen that double-barrel rollers 5 are provided adjacent each end of the shell 1*c* so that the rope 9 is engaged by a double-barrel roller 5 immediately before it emerges from the slot 23.

What I claim is:

1. A rope guide for encircling the drum of a hoist and guiding a rope being wound onto or unwound from a helical rope groove on the drum and pressing the rope into the rope groove, comprising:

a plurality of sectors connected together forming a segmented ring to encircle the drum and turns of rope wound thereon, each sector having a U-shaped interior portion facing radially inwardly toward the exterior of the drum, and one of said sectors having a slot extending therethrough with radially inward converging side walls to facilitate passage of a rope onto or from the drum;

a plurality of axles mounted tranversely in each said U-shaped portion in circumferentially spaced relation;

roller means rotatably mounted on said plurality of axles including disc-shaped drum engaging elements having peripheral surfaces adapted to roll in a vacant portion of the helical rope groove in the drum, and rope engaging elements having disc-shaped portions received in grooves between adjacent turns of rope with inwardly curved surfaces on each outer side of said disc-shaped portion adapted to roll on the outer peripheral surfaces of said two adjacent turns of rope;

means for urging said sectors radially inward toward the drum whereby said disc-shaped drum engaging elements are urged into rolling engagement with the vacant portion of the helical rope groove and said rope engaging elements are urged into rolling engagement with the peripheral surfaces of said adjacent turns of rope and grooves therebetween, and upon relative rotation between said drum and said rope guide, said disc-shaped drum engaging elements rolling in the vacant portion of the helical rope groove and said disc-shaped portion of said rope engaging elements rolling in the grooves between said adjacent turn of rope move said rope guide axially of the drum while maintaining said slot aligned with the helical rope groove, and said rope engaging elements rolling on the peripheral surfaces of the turns of rope press the turns of rope into the helical rope groove of the drum.

2. The rope guide according to claim 1 in which said rope engaging elements have a disc-shaped portion received between adjacent turns of rope and inwardly curved surfaces on each outer side of said disc-shaped portion adapted to roll on the outer peripheral surfaces of said two adjacent turns of rope.

3. The rope guide according to claim 2 in which said disc-shaped drum engaging elements are rotatably mounted on a first series of said plurality of axles, and said rope engaging elements are rotatably mounted on a second series of said plurality of axles.

4. The rope guide according to claim 1 in which said rope engaging elements have a first inwardly curved portion adapted to roll on the outer peripheral surface of a first turn of rope, a disc-shaped portion at each outer end of said first inwardly curved portion received between second and third turns of rope at each side of said first turn of rope, and inwardly curved surfaces on each outer side of each said disc-shaped portion adapted to roll on the outer peripheral surfaces of said second and third turns of rope.

5. The rope guide according to claim 1 in which said plurality of axles are mounted tranversely in each said U-shaped portion at an angle equal to the helix angle of the helical rope groove on the drum.

6. A hoist having a drum provided with a helical rope groove in its peripheral surface for reception of a hoisting rope of the hoist, said hoist comprising:

a rope guide for encircling the drum of a hoist and guiding a rope being wound onto or unwound from the helical rope groove and pressing the rope into the rope groove;

said rope guide formed of a plurality of sectors connected together forming a segmented ring to encircle the drum and turns of rope wound thereon, each sector having a U-shaped interior portion facing radially inwardly toward the exterior of the drum, and one of said sectors having a slot extending therethrough with radially inward converging side walls to facilitate passage of a rope onto or from the drum;

a plurality of axles mounted tranversely in each said U-shaped portion in circumferentially spaced relation;

roller means rotatably mounted on said plurality of axles including disc-shaped drum engaging elements having peripheral surfaces adapted to roll in a vacant portion of the helical rope groove in the drum, and rope engaging elements having disc-shaped portions received between adjacent turns of rope with inwardly curved surfaces on each outer side of said disc-shaped portion adapted to roll on the outer peripheral surfaces of said adjacent turns of rope;

means for urging said sectors radially inward toward the drum whereby said disc-shaped drum engaging elements are urged into rolling engagement with the vacant portion of the helical rope groove and said rope engaging elements are urged into rolling engagement with the peripheral surfaces of the turns of rope, and upon relative rotation between said drum and said rope guide, said disc-shaped drum engaging elements rolling in the vacant portion of the helical rope groove move said rope guide axially of the drum while maintaining said slot aligned with the helical rope groove, and said rope engaging elements rolling on the peripheral surfaces of the turns of rope press the turns of rope into the helical rope groove of the drum.

7. The hoist according to claim 6 in which said rope engaging elements have a disc-shaped portion received between adjacent turns of rope and inwardly curved surfaces on each outer side of said disc-shaped portion adapted to roll on the outer peripheral surfaces of said two adjacent turns of rope.

8. The hoist according to claim 6 in which said rope engaging elements have a first inwardly curved portion adapted to roll on the outer peripheral surface of a first turn of rope, a disc-shaped portion at each outer end of said first inwardly curved portion received between second and third turns of rope at each side of said first turn of rope, and inwardly curved surfaces on each outer side of each said disc-shaped portion adapted to roll on the outer peripheral surfaces of said second and third turns of rope.

9. The hoist according to claim 6 in which said plurality of axles are mounted tranversely in each said U-shaped portion at an angle equal to the helix angle of the helical rope groove on the drum.

* * * * *